US005423140A

United States Patent [19]

Nuspl

[11] Patent Number: 5,423,140

[45] Date of Patent: Jun. 13, 1995

[54] TWO-SIDED DISPLAY

[75] Inventor: Stephan Nuspl, Wauconda, Ill.

[73] Assignee: Robert Nielsen & Associates, Rolling Meadows, Ill.

[21] Appl. No.: 129,748

[22] Filed: Sep. 30, 1993

[51] Int. Cl.[6] ..... G09F 11/18

[52] U.S. Cl. ..... 40/518; 40/597

[58] Field of Search ..... 40/117, 471, 518, 519, 40/520, 521, 522, 523, 5, 597

[56] References Cited

U.S. PATENT DOCUMENTS

| | | | |
|---|---|---|---|
| 1,760,785 | 5/1930 | Sledge et al. | 40/518 |
| 2,127,997 | 8/1938 | Huston et al. | 40/518 |
| 3,065,907 | 11/1962 | Thomas | 40/518 X |
| 4,177,588 | 12/1979 | Gebhardt et al. | 40/518 X |

*Primary Examiner*—Brian K. Green
*Attorney, Agent, or Firm*—Lee, Mann, Smith, McWilliams, Sweeney & Olson

[57] ABSTRACT

A two-sided display for changeably displaying identical indicia, such as letters or numbers, on each side of the display. Two or more rolls of indicia are located in a housing, the housing having openings on each side for display of the numbers or characters. The rolls vary in width, and the smallest roll bears the left-most information to be displayed. Succeeding rolls have their printed information straddling the next preceding roll so that information appears serially and identically on both sides of the display. Due to use of rolls, changing of the indicia on one side of the display automatically changes the indicia identically on the other side of the display.

19 Claims, 4 Drawing Sheets

10
12
16
88
88
88
88
35
20
49
65
22
22
90
To-day's
Low Price
5
4
1

10
14
18
3.
88
88
88
88
34
24
48
64
26
26
90
BEST
BUY
5
4
1
3.

TWO-SIDED DISPLAY

BACKGROUND OF THE INVENTION

This invention relates to displays, such as displays for pricing commodities, and in particular to a two-sided display for changeably displaying identical indicia on each side of the display.

Displays, for example pricing information for commodities, need to be readily changeable as the prices vary with price changes from the manufacturer, periodic sales, changes of the product, and other similar events. Often, prices are posted by simply writing a price on a display for the product, an inefficient use of the display since as soon as the price changes, the display must be replaced or an overlay placed on the price in order to display the new price.

In some displays, pricing information is available by simply altering changeable numbers. This can be by removing numbers and placing new numbers in their place, sliding numbers up or down to display new numbers, or the like. In the past, two-sided displays, such as displays located in a window, have simply been duplication of single-sided displays, therefore requiring the user to sequentially change the information on both sides of the display. If changes are not made to both sides, or if the changes are not made identically, incorrect information can appear on one side of a two-sided display, leading to unwelcomed problems for the merchant.

SUMMARY OF THE INVENTION

The present invention is directed to a two-sided display for changeably displaying identical indicia on each side of the display. The display includes a housing, with the housing having opposite display sides, each side having a display opening. A first indicia carrier is provided, the first carrier being generally flat and having a pair of elongated, identical display columns each having a fixed width and bearing serial indicia arrays. One of the first carrier display columns is located on one side of the first carrier and the other of the display columns is located on a second side of the carrier, with the columns spanning a predetermined width of the first carrier. Means is provided for mounting the first carrier in the housing for selectively positioning the serial indicia arrays in the display openings on both sides of the display.

A second indicia carrier is also provided, the second carrier being generally flat and having a pair of identical display columns bearing serial indicia arrays. One of the second carrier display columns is located on one side of the second carrier and the other of the second carrier display columns is located on a second side of the second carrier. The second carrier display columns are separated the predetermined width of the combined columns of the first carrier display. Means forming a transparent gap between the second carrier display columns is provided, with the gap having a width about equal to the fixed width of the columns of the first display. Means is also provided for mounting the second carrier in the housing for selectively positioning the indicia arrays of the second carrier in the display openings and with the two carriers being juxtaposed one another such that one of the first carrier display columns is in registration with the gap in the second carrier.

In accordance with the preferred form of the invention, the second carrier display columns span a predetermined interval and each second carrier column has the same fixed width as the columns of the first carrier. A third indicia carrier is provided, the third indicia carrier being generally flat and having a pair of identical display columns bearing serial indicia arrays. One of the third carrier display columns is located on one side of the third carrier and the other of the third carrier display columns is located on a second side of the third carrier. The third carrier display columns are separated the predetermined interval constituting the span of the display columns of the second carrier. Means is provided forming a transparent second gap between the third carrier display columns, the second gap having a width about equal to twice the fixed width of the display columns. Means is also provided for mounting the third carrier in the housing for selectively positioning the indicia arrays of the third carrier in the display openings and with the three carriers being juxtaposed one another such that one of the second carrier display columns and one of the first carrier display columns are in registration with the second gap formed in the third carrier.

In accordance with the preferred form of the invention, the serial indicia arrays of each of the columns comprise serial characters. Typically, the characters comprise digits. In the preferred form of the invention, the indicia carriers are symmetrical, and the predetermined width spanned by the columns of the first carrier display is twice the fixed width of one of the columns.

For mounting the first carrier in the housing, a flat shield is provided, located in the housing and having an aperture having a width at least twice the fixed width, and preferably three times that width, in order to display three characters therein. The mounting means also includes a pair of spaced stops extending within the housing and sandwiching the first carrier therebetween.

For mounting of the second carrier, a flat shield is provided, located in the housing and having an aperture having a width at least equal to the fixed width of a column, and preferably twice that width in order to allow two characters to be displayed therethrough. Also included is a pair of spaced stops extending within the housing and sandwiching the second carrier therebetween.

The third carrier is also mounted on a flat shield located in the housing and having an aperture having an aperture at least equal to the fixed width of a column. The third carrier is also mounted between a pair of spaced stops extending within the housing and sandwiching the third carrier therebetween.

In accordance with the preferred form of the invention, the indicia carriers comprise spring rolls. The rolls are unrolled over a flat area in the vicinity of the openings in the housing so that characters can be displayed through the openings. The rolls are accessible through the openings on one side of the display so that the indicia of the rolls can readily be changed from the one side, and once changed, identical information appears in the openings on both sides of the display.

The display is intended to be located in a window or other location where both sides of the display are readily visible. To that end, at least one suction cup, and preferably four at each of the four corners of the housing, are provided to mount the housing firmly on a window or other appropriate surface.

The rolls are mounted in the housing one above the other. Thus, the housing can be made quite compact in relation to the size of the openings in the opposite sides of the housing.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
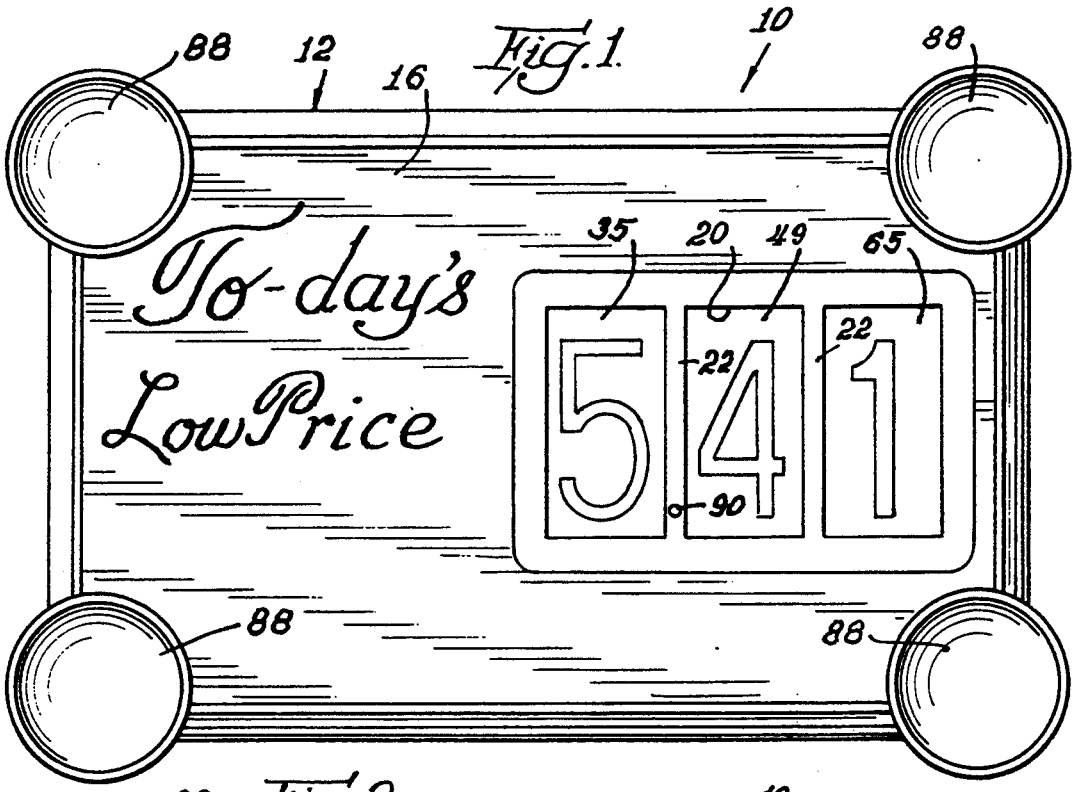
FIG. 1 is an elevational view of one side of a display according to the invention.

A two-sided display according to the invention is shown generally at 10 in the drawing figures. The display 10 includes a housing formed of opposite sides 12 and 14 which are appropriately secured together, such as by gluing, sonic welding, screwing together, or other appropriate means.

Each of the sides 12 and 14 may include whatever information might be desired to be carried by the display 10, either on an overlay 16 and 18, or being directly applied to the housing portions 12 and 14. Indicia carried by the opposite sides of the display 10 can be identical or not, as desired by the user.

The housing side 12 includes an opening 20 on one side of the housing side 12 as illustrated. The opening 20 can comprise a single aperture or, as illustrated, can include partitions 22 which form an aesthetic separation between adjacent characters, as explained in greater below.

Figure 3:
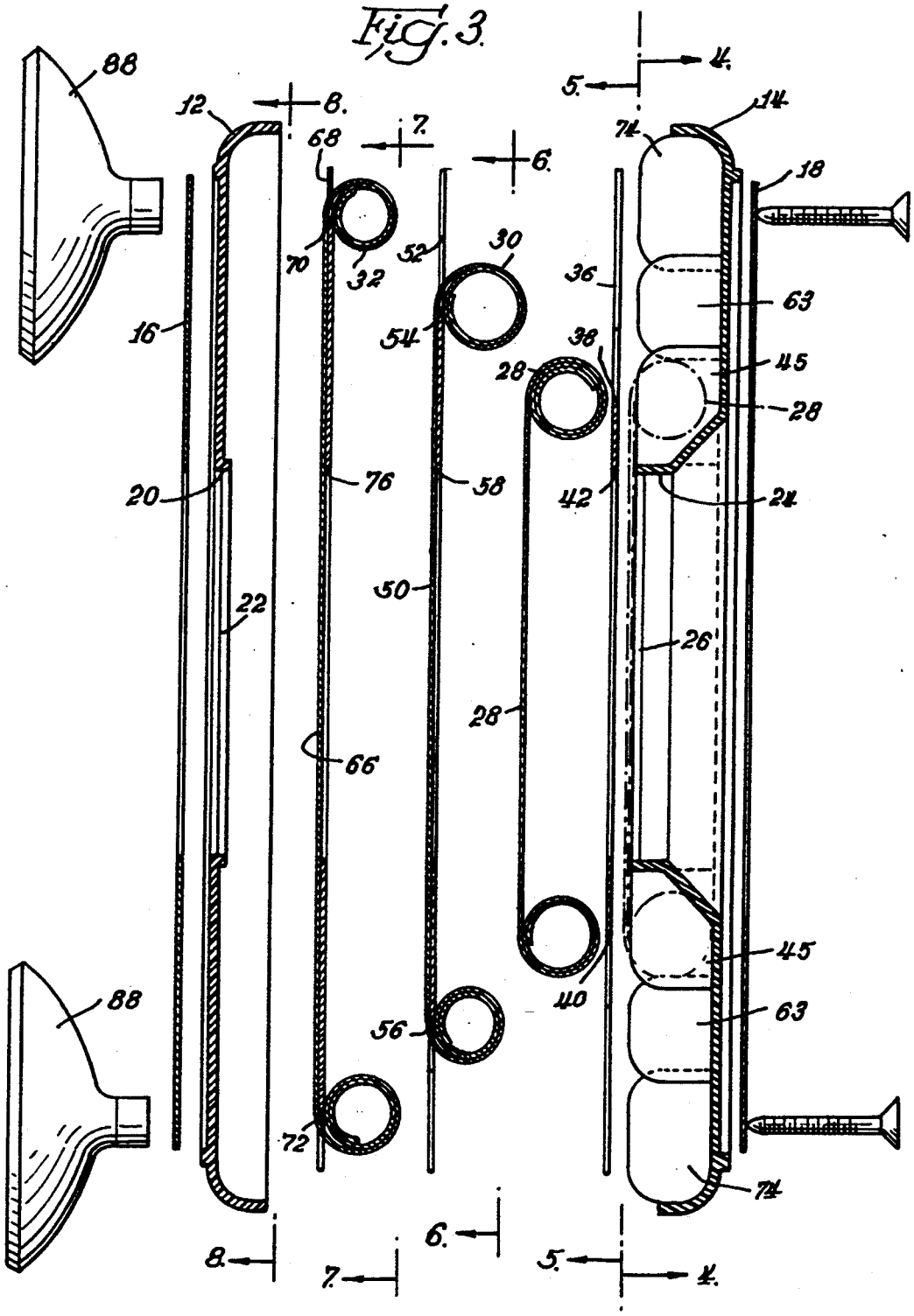
FIG. 3 is an exploded, enlarged cross-sectional view taken along lines 3—3 of FIG. 2.

Similarly, the housing side 14 includes an opening 24 on one side thereof, either formed of a single aperture or being aesthetically divided with partitions 26 to define between adjacent characters displayed through the opening 24. The openings 20 and 24 are oriented in mirror images to one another so that identical indicia is displayed through each of the openings 20 and 24 as explained below. Also, the opening 24 is shown indented in the housing side 14 (as best illustrated in FIG. 3), while the opening 20 is not indented in the housing side 12. The indentation of the opening 24 is to firmly capture displays of information within the housing, and depending on the geometry of the display 10, neither or both of the openings 20 and 24 can be indented, as required.

Information displayed through the openings 20 and 24 is carried on three spring rolls 28, 30 and 32. Each of the spring rolls 28–32 may be made of plastic or any other appropriate material which can retain a memory so that the roll is self-rolling when information displayed in the openings 20 and 24 is changed.

Figure 5:
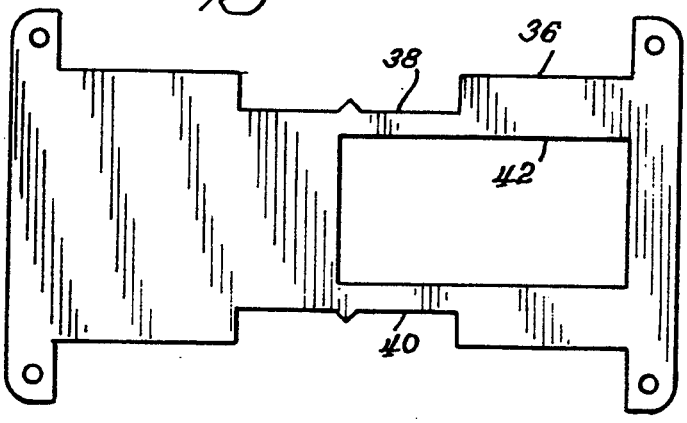
FIG. 5 is a reduced-size cross-sectional view taken along lines 5—5 of FIG. 3.
Figure 5A:
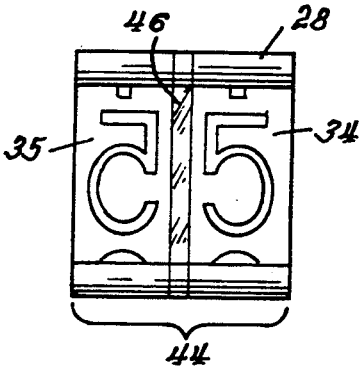
FIG. 5A is an elevational illustration of the spring roll used in combination with the shield shown in FIG. 5.

The roll 28, as best shown in FIGS. 3 and 5A, carries a pair of columns 34 and 35 of serial indicia arrays, in this instance serial characters comprising numbers for displaying prices through the respective openings 20 and 24. The material forming the spring roll 28 may be opaque or, as illustrated, translucent so that characters carried in the columns 34 and 35 are visible from either side of the spring roll 28. Information contained in the columns 32 and 34 is identical, merely being a mirror image in one column in relation to the other, so that the information in the columns can be displayed through the respective openings 20 and 24. As illustrated in FIG. 5A, the numbers 5 are displayed on the spring roll 28, and those numbers consequently appear through the openings 20 and 24 in the leftmost position shown in FIGS. 1 and 2.

The spring roll 28 is carried on a flat shield 36. The shield 36 includes opposite depressions 38 and 40 which accommodate opposite ends of the roll 28, the depressions 38 and 40 being sized to snugly accommodate the roll 28. The flat shield 36 includes an aperture 42 therein, so that the numbers of the column 34, when the roll 28 is mounted on the shield 36, appear through the aperture 42. As will be explained in greater detail below, the aperture 42 is sufficiently wide so that numbers of the rolls 30 and 32 also appear through the aperture 42.

The aperture 42 extends in only half the flat shield 36, so that the remainder of the shield 36 forms an opaque backing for numbers of the column 35 when the roll 28 is mounted on the shield 36. That opaque backing also serves as a backing for the numbers of the spring rolls 30 and 32, as explained below.

Figure 2:
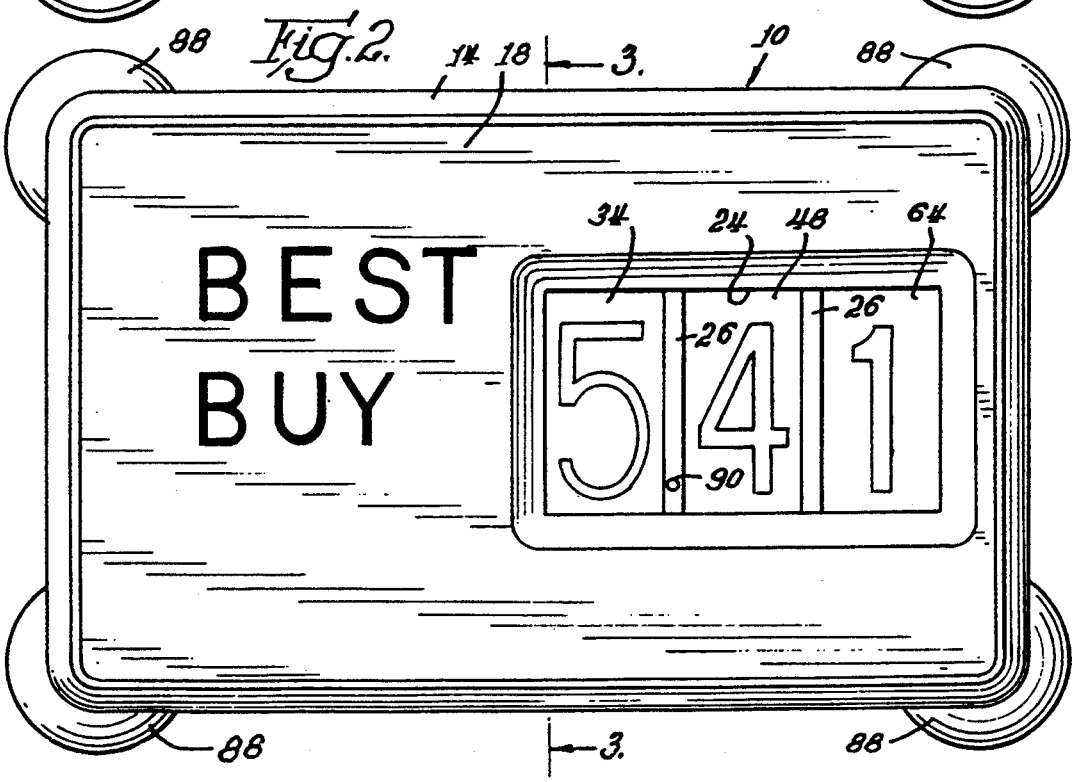
FIG. 2 is an elevation view similar to FIG. 1, but of the opposite side of the display.

The spring roll 28 has a particular width 44 as depicted in FIG. 5A. The width 44 is determined by the relationship of the number of rolls carried within the display 10 and the sizes of the openings 20 and 24. When the roll 28 is mounted within the display 10 as shown in FIGS. 1 and 2, the columns 34 and 35 fully occupy their respective positions in the openings 20 and 24.

Figure 4:
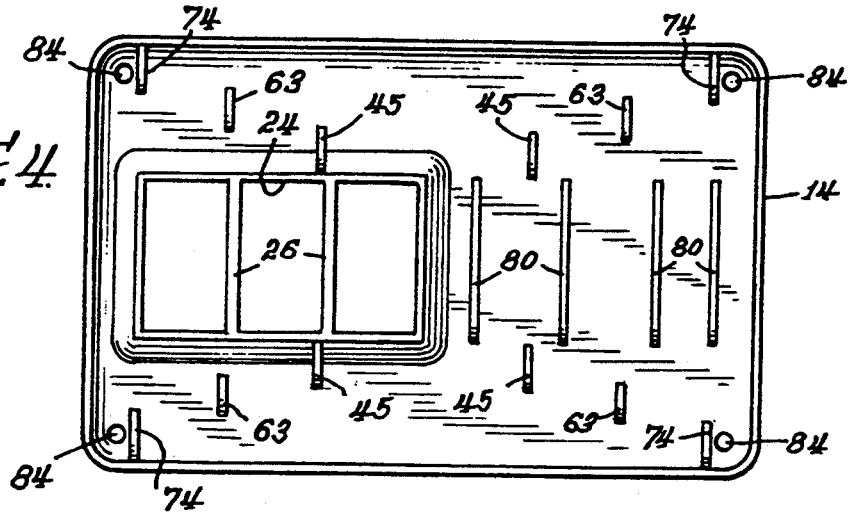
FIG. 4 is a reduced-size cross-sectional view taken along lines 4—4 of FIG. 3.

When the shield 36 and the spring roll 28 are mounted within the display 10, the spring roll 28 is also captured between two pairs of stops 44 extending from the housing side 14 as illustrated in FIG. 4. The stops 44 are configured to extend within the depressions 38 and 40.

The columns 34 and 35 each have the same, fixed width. The columns 34 and 35 can be contiguous to one another, or, depending on the geometry of the housing sides 12 and 14, a small opaque or transparent division 46 may appear between the columns 34 and 35.

The roll 30, similar to the roll 28, is formed with a pair of columns 48 and 49. The columns 48 and 49, however, are separated by a transparent gap 50. The gap 50 is sufficiently wide so that the characters of the columns 34 and 35 appear through the gap 50. The gap 50 may be slightly less in width than the width 44 so that the columns 34 and 48, on the one hand, and the columns 45 and 49, on the other hand, slightly overlap so that no unsightly gaps appear between the columns when viewed through the openings 20 and 24. As will be apparent from the geometry of the two rolls 28 and 30 when juxtaposed one another within the display 10, the minimum width of the gap 50 must be that of the column 35, since the column 35 must appear through the gap 50 in order to be viewed in the opening 24.

Similar to the roll 28, the roll 30 is mounted on a shield 52 in a pair of depressions 54 and 56. The shield 52 includes a pair of apertures 58 and 60. When the roll 30 is mounted on the shield 52, the characters of the column 48 appear through the aperture 58 and therefore also through the aperture 42.

It is preferred that the columns 48 and 49 have widths equal to the columns 34 and 35 so that the display 10 is geometrically balanced. Obviously, such is not mandatory.

Figure 6:
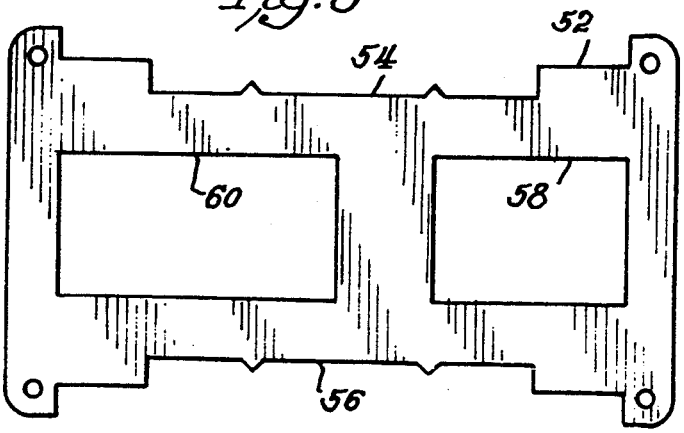
FIG. 6 is a reduced-size cross-sectional illustration taken along lines 6—6 of FIG. 3 (with the roll eliminated)
Figure 6A:
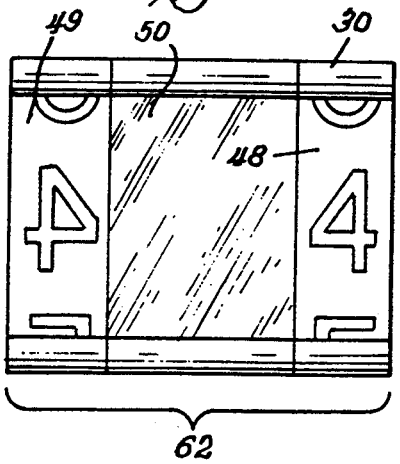
FIG. 6A is an elevational illustration of a spring roll used in combination with the shield of FIG. 6.
Figure 7:
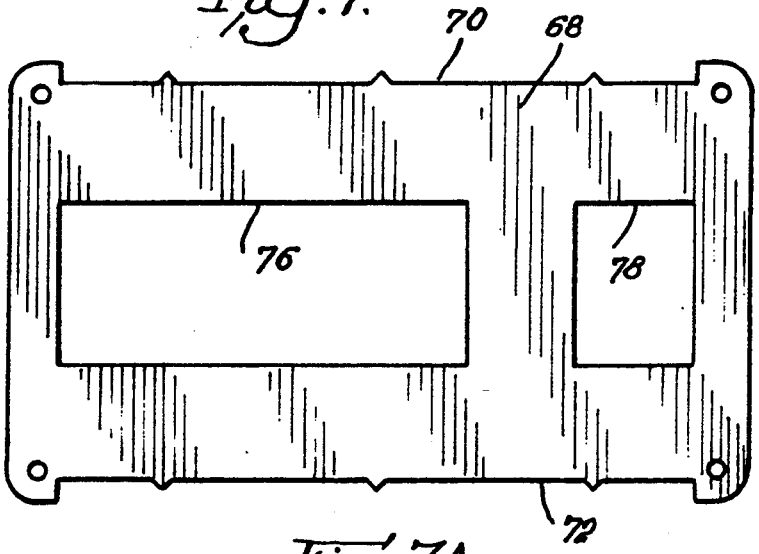
FIG. 7 is a reduced-size cross-sectional illustration taken along lines 7—7 of FIG. 3 (with the spring roll eliminated)
Figure 7A:
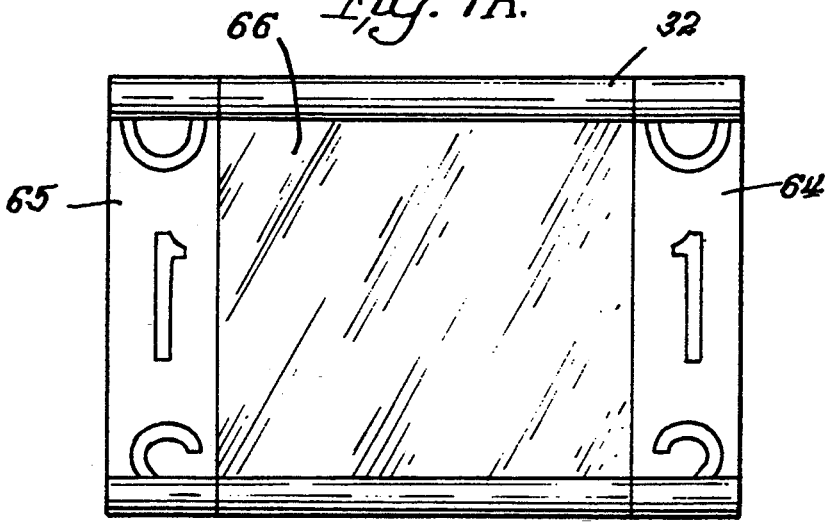
FIG. 7A is an elevational illustration of a spring roll used in combination with the shield of FIG. 7.
Figure 8:
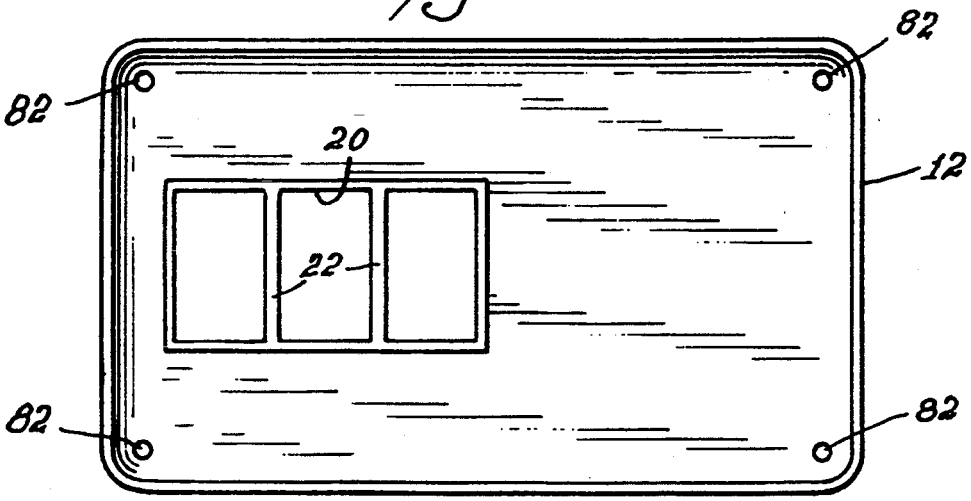
FIG. 8 is a reduced-size cross-sectional illustration taken along lines 8—8 of FIG. 3.

The roll 30 has a width spanning a predetermined interval shown generally at 62 in FIG. 6A. The interval 62 is defined by the width of the two columns 48 and 49 and the width of the transparent gap 50. If the columns 34, 35, 48 and 49 are equal in width and the gap 50 is approximately the width of two columns, then the interval 62 is approximately the width of four columns.

When the shield 52 and the spring roll 30 are mounted within the display 10, the spring roll 30 is also captured between two pairs of stops 63. The stops 63 are configured to extend within the depressions 54 and 56.

The roll 32, similar to the roll 30, is formed of a pair of columns 64 and 65 separated by a transparent gap 66. The transparent gap 66 is sufficiently wide so as to accommodate the width of the roll 30 and display the column 49 therethrough. Thus, displayed through the transparent display 66 are at least the characters of both the columns 49 and 35.

The roll 32 is mounted on a flat shield 68 in a pair of depressions 70 and 72. When within the display 10, the roll 32 is also captured between two pairs of stops 74 in the housing side 14.

The shield 68 includes a pair of apertures 76 and 78. When the roll 32 is mounted on the shield 68, the characters of the column 64 appear through the aperture 78, and therefore in the opening 24, as illustrated.

The housing side 14 also may include a series of spacers 80 extending within the display 10 to the extent of the depression of the opening 24. The spacers 80, in combination with the depressed opening 24, serve to firmly sandwich the rolls 28–32 when the display 10 is assembled.

For assembly purposes, the sides 12 and 14 each include respective corner openings 82 and 84. Screws 86 pass through the openings 82 and 84 and extend into four suction cups 88 in the four corners of the display 10. The screws 86, in combination with the suction cups 88, may comprise the means of assembly of the display 10. As illustrated, each of the shields 36, 52 and 68 includes corner holes in registration with the openings 82 and 84 so that the screws 86 may pass therethrough.

The suction cups 88 serve as a means of mounting the display 10 on a window or other similar flat surface. The suction cups 88 are sufficiently spaced so that they do not visually interfere with information displayed in the opening 20.

When the display 10 is assembled in the manner illustrated in FIG. 3, the columns 34, 48 and 64 appear through the opening 24. Because of the widths of the respective rolls 28–32, each of the columns 34, 48 and 64 can be accessed through the opening 24. Therefore, changing of the numbers appearing through the openings 24 and 20 is readily accomplished by simply moving the columns 34, 48 and 64 up or down (in relation to FIG. 2), which simultaneously changes the columns 35, 49 and 65 displayed through the opening 20. A decimal point 90 can be located on each of the partitions 22 and 26 as necessary for displaying of information appearing through the openings 20 and 24. Obviously, the decimal point 90 is optional depending on what is displayed through the openings 20 and 24.

Various changes can be made to the invention without departing from the spirit thereof or scope of the following claims.

What is claimed is:

1. A two-sided display for changeably displaying identical indicia on each side of the display, comprising a. a housing, said housing having opposite display sides, each side having a display opening, b. a first indicia carrier, said first carrier having a generally flat portion and having a pair of elongated identical display columns having a fixed width and bearing serial indicia arrays, one of said first carrier display columns being located on one side of said first carrier and the other of said first carrier display columns being located on a second side of said first carrier, said first carrier display columns combined spanning a predetermined width of said first carrier, c. means mounting said first carrier in said housing for selectively positioning said serial indicia arrays in said display openings, d. a second indicia carrier, said second carrier having a generally flat portion and having a pair of identical display columns bearing serial indicia arrays, one of said second carrier display columns being located on one side of said second carrier and the other of said second carrier display columns being located on a second side of said second carrier, said second carrier display columns being separated the predetermined width of said first carrier, e. means forming a transparent gap between said second carrier display columns, said gap having a width at least equal to about said predetermined width of said first carrier, and f. means mounting said second carrier in said housing for selectively positioning the indicia arrays of said second carrier in said display openings and with said carriers juxtaposed one another such that one of said first carrier display columns is in registration with said gap.

2. A two-sided display according to claim 1 in which said second carrier display columns span a predetermined interval and each second carrier column has said fixed width, and including a third indicia carrier, said third indicia carrier having generally flat portion and having a pair of identical display columns bearing serial indicia arrays, one of said third carrier display columns being located on one side of said third carrier and the other of said third carrier display columns being located on a second side of said third carrier, said third carrier display columns being separated at least said predetermined interval, means forming a transparent second gap between said third carrier display columns, said second gap having a width equal to twice said fixed width, and means mounting said third carrier in said housing for selectively positioning the indicia arrays of said third carrier in said display openings and with said carriers juxtaposed one another such that one of said second carrier display columns and said one first carrier display column are in registration with said second gap.

3. A two-sided display according to claim 1 in which said serial indicia arrays comprise serial characters.

4. A two-sided display according to claim 3 in which said characters comprise digits.

5. A two-sided display according to claim 1 in which said predetermined width is twice said fixed width.

6. A two-sided display according to claim 1 in which said means mounting said first carrier comprises a flat shield located in said housing and having an aperture having a width at least twice said fixed width.

7. A two-sided display according to claim 6 in which said means mounting said first carrier further includes a pair of spaced stops extending within said housing and sandwiching said first carrier therebetween.

8. A two-sided display according to claim 1 in which said means mounting said second carrier comprises a flat shield located in said housing and having an aperture having a width at least equal to said fixed width.

9. A two-sided display according to claim 8 in which said means mounting said second carrier further includes a pair of spaced stops extending within said housing and sandwiching said second carrier therebetween.

10. A two-sided display according to claim 1 in which said indicia carriers comprise spring rolls.

11. A two-sided display according to claim 1 including at least one suction cup secured to said housing for mounting of said housing to a surface.

12. A two-sided display for changeably displaying identical characters on each side of a the display, comprising a. a housing, said housing having opposite display sides, each side having a display opening, b. a first character carrier, said first carrier comprising a rolled flat sheet having a pair of elongated identical display columns having a fixed width and bearing serial arrays of characters, one of said first carrier display columns being located on one side of said sheet and the other of said first carrier display columns being located on a second side of said sheet, said first carrier display columns combined spanning a predetermined width, c. means mounting said first carrier in said housing for selectively positioning the same characters of said serial arrays in said display openings, d. a second character carrier, said second carrier comprising a rolled flat sheet having a pair of elongated identical display columns having said fixed width and bearing serial arrays of characters, one of said second carrier display columns being located on one side of said sheet and the other of said second carrier display columns being located on a second side of said sheet, said second carrier columns being separated by said predetermined width and spanning a predetermined interval, e. means forming a transparent gap between said second carrier display columns, said gap having a width substantially equal to said predetermined width, f. means mounting said second carrier in said housing for selectively positioning the characters of said second carrier in said display openings and with said carriers juxtaposed one another such that said first carrier display columns are in registration with said gap, g. a third character carrier, said third carrier comprising a rolled flat sheet having a pair of elongated identical display columns having said fixed width and bearing serial arrays of characters, one of said third carrier display columns being located on one side of said sheet and the other of said third carrier display columns being located on a second side of said sheet, said third carrier display columns being separated at least said predetermined interval of said second character carrier, h. means forming a transparent second gap between said third carrier display columns, said second gap having a width substantially equal to said predetermined interval, and i. means mounting said third carrier in said housing for selectively positioning the characters of said third carrier in said display openings and with said carrier in said display openings and with said carriers juxtaposed one another such that said first and second carrier display columns are in registration with said second gap.

13. A two-sided display according to claim 12 in which said characters comprise digits.

14. A two-sided display according to claim 12 in which said means mounting said first carrier comprises a flat shield located in said housing and having an aperture having a width at least three times said fixed width.

15. A two-sided display according to claim 12 in which said means mounting said first carrier comprises a flat shield located in said housing and having an aperture having a width at least twice said fixed width.

16. A two-sided display according to claim 12 in which said means mounting said third carrier comprises a flat shield located in said housing and having an aperture having a width at least equal to said fixed width.

17. A two-sided display according to claim 12 in which said character carriers comprise spring rolls.

18. A two-sided display according to claim 17 in which said rolls are mounted one above another in said housing.

19. A two-sided display according to claim 12 in which said predetermined width is twice said fixed width.

* * * * *